US008505787B2

(12) United States Patent
Fox et al.

(10) Patent No.: US 8,505,787 B2
(45) Date of Patent: Aug. 13, 2013

(54) MAGNETICALLY-BIASED EXTENDABLE SPOUT

(75) Inventors: Ryan Fox, Mississauga (CA); Andrew Fox, Mississauga (CA)

(73) Assignee: 2308479 Ontario Limited, Mississauga (CA)

( * ) Notice: Subject to any disclaimer, the term of this patent is extended or adjusted under 35 U.S.C. 154(b) by 78 days.

(21) Appl. No.: 13/323,549

(22) Filed: Dec. 12, 2011

(65) Prior Publication Data

US 2013/0146621 A1 Jun. 13, 2013

(51) Int. Cl.

| | |
|---|---|
| ***B65D 5/72*** | (2006.01) |
| ***B65D 25/40*** | (2006.01) |
| ***B65D 35/38*** | (2006.01) |
| ***B65D 51/00*** | (2006.01) |
| ***B67D 3/00*** | (2006.01) |
| ***B67D 7/06*** | (2010.01) |

(52) U.S. Cl.
USPC ..... 222/566; 222/511; 222/513; 222/514; 220/230

(58) Field of Classification Search
USPC ..... 222/566, 527, 530, 535, 568, 511, 222/513, 514, 518; 220/230
See application file for complete search history.

(56) References Cited

U.S. PATENT DOCUMENTS

| | | | | |
|---|---|---|---|---|
| 1,190,612 | A * | 7/1916 | Weil | 222/527 |
| 1,804,627 | A * | 5/1931 | Lukenbill | 215/363 |
| 2,147,289 | A * | 2/1939 | Furedy | 222/514 |
| 2,773,632 | A | 12/1956 | Dobbins, III | |
| 3,132,776 | A | 5/1964 | Wasserberg | |
| 3,217,935 | A * | 11/1965 | Burt | 222/109 |
| 3,717,289 | A * | 2/1973 | Laurizio | 222/481 |
| 5,107,909 | A | 4/1992 | Donovan | |
| 6,026,994 | A | 2/2000 | Rigel | |
| 6,976,610 | B2 * | 12/2005 | Rigel | 222/523 |
| 2006/0060610 | A1 * | 3/2006 | Morita et al. | 222/333 |
| 2007/0039980 | A1 * | 2/2007 | Kjeldsen et al. | 222/514 |
| 2007/0151992 | A1 * | 7/2007 | Carlson et al. | 222/509 |
| 2007/0278256 | A1 * | 12/2007 | Law et al. | 222/530 |
| 2008/0197209 | A1 * | 8/2008 | Ganzer | 239/8 |
| 2010/0206914 | A1 * | 8/2010 | Doron | 222/517 |
| 2011/0132926 | A1 * | 6/2011 | Feierabend et al. | 222/47 |
| 2013/0068799 | A1 * | 3/2013 | Rigel | 222/481 |

* cited by examiner

*Primary Examiner* — J. Casimer Jacyna
*Assistant Examiner* — Benjamin R Shaw
(74) *Attorney, Agent, or Firm* — Hanley, Flight & Zimmerman, LLC

(57) ABSTRACT

A spout assembly configured to be attached to a mouth of a bottle to facilitate pouring of the contents of the bottle. The spout assembly includes a cap having an upper surface and defining an axial passageway; a spout mounted within the cap and movable between a retracted position, in which the spout is disposed within the axial passageway below the upper surface, and an extended position, in which at least a portion of the spout extends above the upper surface; and a first polarized magnet attached to the cap and a second polarized magnet attached to the spout, wherein the first polarized magnet and second polarized magnet magnetically bias the spout into the extended position.

15 Claims, 11 Drawing Sheets

MAGNETICALLY-BIASED EXTENDABLE SPOUT

FIELD

The present application relates to a magnetically-biased extendable spout for use with containers.

BACKGROUND

Pouring a liquid from a conventional bottle, such as a glass or plastic bottle with a neck and round mouth, can result in drips running down the side of the bottle when the bottle is returned to an upright position. The liquid also typically pours from such a mouth in a somewhat unpredictable manner that can lead to spills. Fewer drips and spills occur if the bottle is provided with a spout.

A conventional screw top lid is usually incompatible with a spout. An after-market spout may be used to aid in pouring accuracy once the lid is removed. Spouts for wine or liquor bottles typically push-fit into the mouth of the bottle and need to be removed before the lid or a cork is replaced on the bottle.

U.S. Pat. Nos. 6,026,994 and 6,976,610 describe spring-loaded spouts that may be incorporated into a bottle design. The spring-loaded spout is designed to pop-up to an extended position to facilitate pouring.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DETAILED DESCRIPTION

In accordance with the present application, there is provided a spout assembly configured to be attached to a mouth of a container. The spout assembly includes a cap having an upper surface and defining an axial passageway; a spout mounted within the cap and movable between a retracted position, in which the spout is disposed within the axial passageway below the upper surface, and an extended position, in which at least a portion of the spout extends above the upper surface; and a first polarized magnet attached to the cap and a second polarized magnet attached to the spout, wherein the first polarized magnet and second polarized magnet magnetically bias the spout to the extended position.

Figure 1:
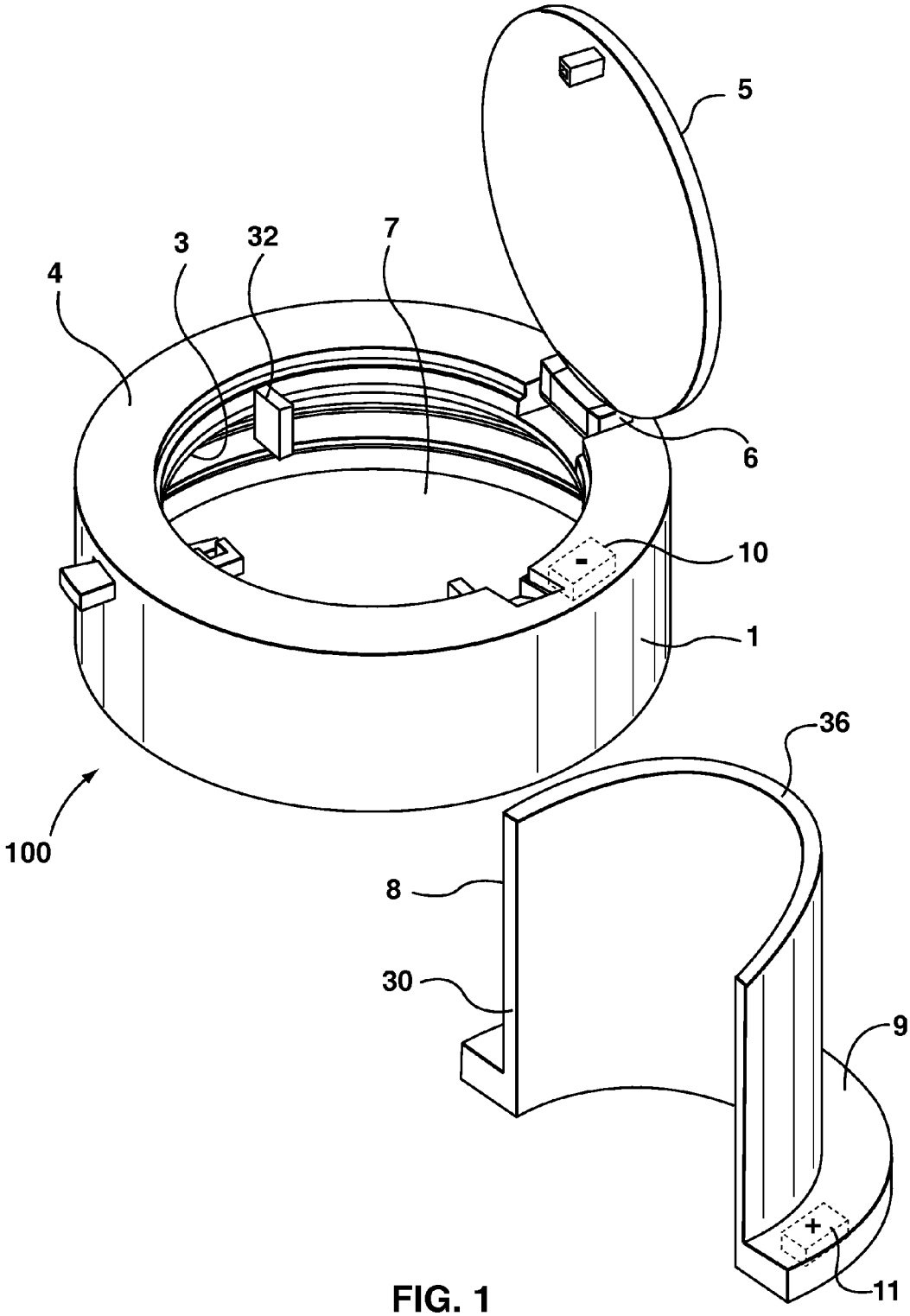
FIG. 1 shows a perspective view of a spout assembly.

Reference is first made to FIG. 1, which shows a perspective view of the spout assembly. The spout assembly 100 includes a cap 1 and an extendable spout 8. The cap 1 is configured to be attached to the mouth of a container, such as a bottle (not shown). The cap 1 includes an axial passageway 7, which, when attached to the bottle, is in open communication with the bottle mouth thereby allowing the contents of the bottle to be poured through the spout assembly 100. The spout 8 is mounted within the cap 1, specifically within the axial passageway 7. The spout 8 is movable between a retracted position and an extended position, and is magnetically-biased towards the extended position, as will be explained further below.

The cap 1 may be configured to be removably attached to a bottle or permanently attached to the bottle. For example, in the example embodiment shown in FIG. 1, the cap 1 has threads on at least a portion of the interior surface of the axial passageway 7 to allow the spout assembly to be screwed onto cooperating threads on the bottle. In other embodiments, the cap 1 may be configured to be friction fit or snap fit to the mouth of the bottle. In some embodiments, the cap 1 may be removable, and in other embodiment the cap 1 may be designed for permanent attachment to the mouth of the bottle. It will be appreciated that the axial passageway 7 may have an annular recess in its lower portion to accommodate the thickness of the mouth of the bottle without interfering with the operation of the extendable spout 8, which is described below. Suitable mechanisms for attaching the cap 1 to various bottles will be understood by those ordinarily skilled in the art in light of the following description.

The cap 1 may further have an inwardly projected flange 3 within the axial passageway 7 below the upper surface 4 of the cap 1. The inwardly projected flange 3 may not be continuous around the interior perimeter of the axial passageway 7. In some embodiments, the inwardly projected flange 3 may include two or more flanges separated by gaps.

In some embodiments, the spout assembly 100 may further include a hinged lid 5 attached to the cap 1. The hinged lid 5 may be attached to the cap 1 by way of a hinge mechanism 6. The hinge mechanism 6 allows the lid 5 to pivot from a closed position, in which the lid 5 blocks the axial passageway 7, to an open position. The lid 5 may, in some embodiments, close against the upper surface 4 of the cap 1. In some embodiments, the upper surface 4 may feature an annular recess around the axial passageway 7 into which the lid 5 fits when in the closed position. In either case, the lid 5 or cap 1 may include one or more seals to prevent leakage of liquid through the closed lid 5.

When the lid 5 is in the closed position, the axial passageway 7 is blocked to prevent the contents of the bottle from spilling out, and the spout 8 is maintained in the retracted position. The lid 5 may be connected to the cap 1 by other means including as a removable lid 5 that fits on to the upper surface 4 of the cap 1. In other embodiments, the spout assembly 100 may include a screw top lid, a snap-on lid, or other lid-type closures for sealing the bottle and holding the spout 8 in the retracted position.

Figure 2:
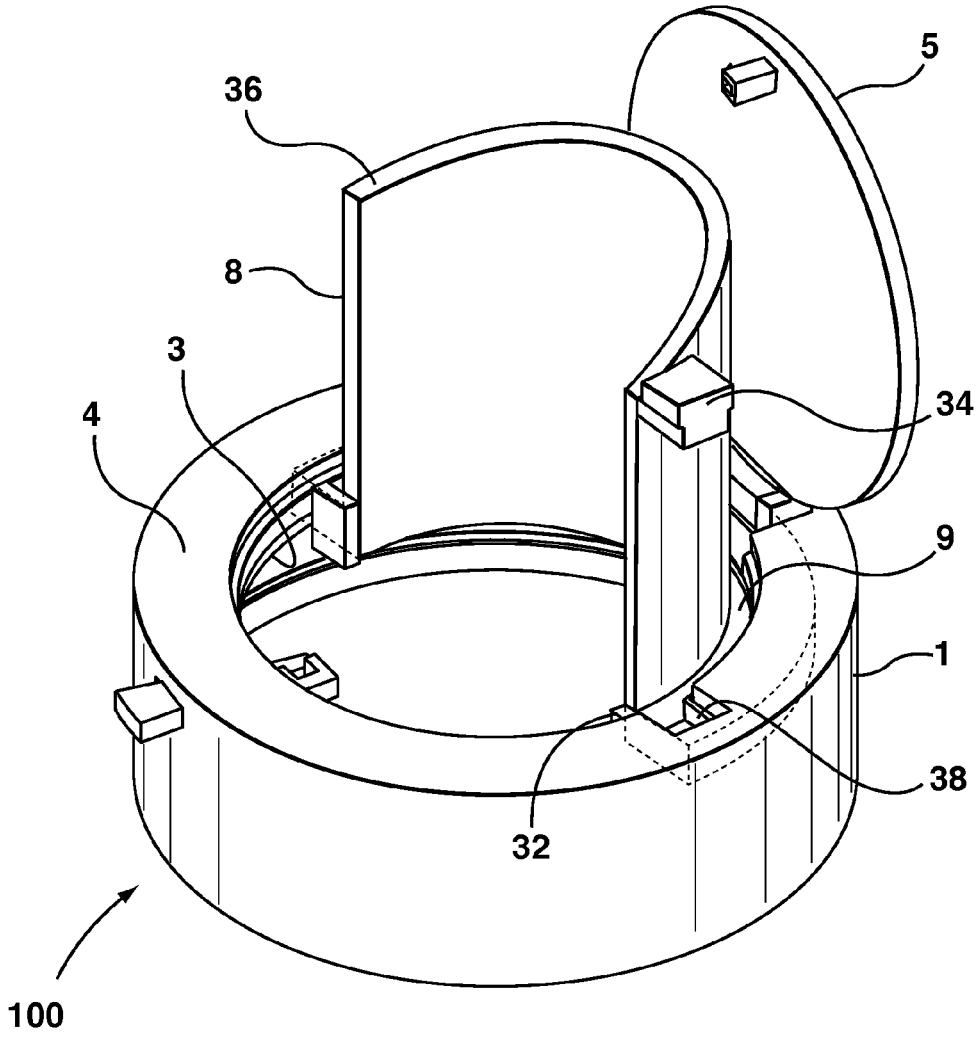
FIG. 2 shows a perspective view of the spout assembly when a spout is in an extended position.

Reference is now also made to FIG. 2, which shows a perspective view of the spout assembly 100 with the spout 8 in the extended position. FIG. 1 shows the spout 8 in the retracted position. When the spout 8 is in the retracted position, it is disposed within the axial passageway 7 and does not extend above the upper surface 4 of the cap 1. When the spout 8 is in the extended position, as shown in FIG. 2, at least a portion of the spout 8 extends above the upper surface 4 of the cap 1.

Figure 3:
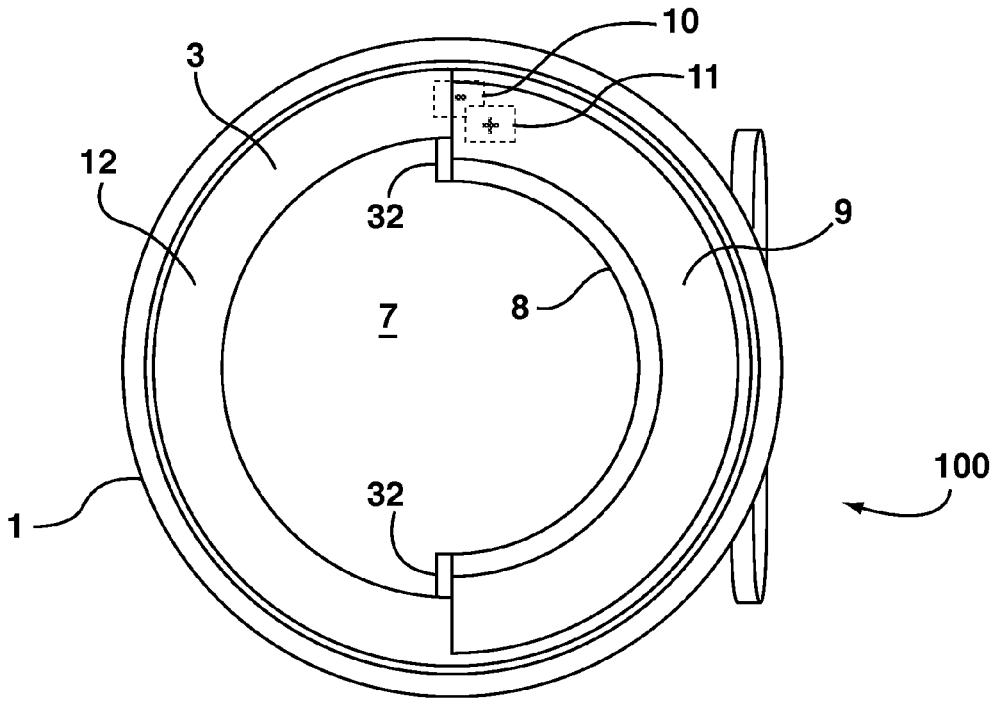
FIG. 3 shows a bottom view of the spout assembly when the spout is in the extended position.

The spout 8 in this example includes an outwardly projected flange 9 which engages the inwardly projected flange 3 of the cap 1 when the spout 8 is in the extended position to prevent the spout 8 from moving beyond the extended position and being removed from the cap 1. Reference is now also made to FIG. 3, which shows a bottom view of the spout assembly 100, with the spout 8 in the extended position. It will be noted that the curved outer surface of the spout 8 lies against the inner surface of inwardly projected flange 3, such that the outwardly projected flange 9 overlaps the inwardly projected flange 3 and the two flanges 3, 9 contact each other when the spout 8 is in the extended position.

As mentioned above, the spout 8 is magnetically-biased toward the extended position. Accordingly, when the lid 5 is removed or is pivoted to the open position, the spout 8 is magnetically urged towards the extended position. The magnetic biasing is established through magnets in the cap 1 and spout 8.

In a first embodiment, a first polarized magnet 10 is attached to the cap 1 and a second polarized magnet 11 is attached to the spout 8. In this embodiment, the first polarized magnet 10 is disposed at the inwardly projected flange 3 of the cap 1 and the second polarized magnet 11 is located at the outwardly projected flange 9 of the spout 8. In this embodiment, the magnets 10, 11 are positioned relative to each other to have poles of opposite polarity facing so that the magnetic bias is an attractive force that draws the two magnets 10, 11 together. With the spout 8 in the retracted position, when the lid 5 is unlocked, the magnetic biasing attracts the outwardly projected flange 9 of the spout 8 towards the inwardly projected flange 3 of the cap 1 causing the spout 8 to move towards the extended position.

In another embodiment, the first polarized magnet 10 may be located elsewhere within or on the inner wall of the cap 1 itself, and the second oppositely polarized magnet 11 may be located in or on the spout 8, provided that the first polarized magnet 10 is at a higher level position than the second polarized magnet 11 when the spout 8 is in the retracted position. The range of extension will be governed by the distance between the two magnets 10, 11 when the spout is in the retracted position since the spout 8 will extend by that distance as the two magnets 10, 11 are drawn together.

In either of these embodiments, the first polarized magnet 10 attached to the cap 1 is located closer to the upper surface 4 of the cap 1 than the second polarized magnet 11 when in the retracted position.

In another embodiment, the first polarized magnet 10 is positioned such that the poles of the two magnets 10, 11 facing each other have the same polarity. In such an embodiment, the magnets 10, 11 exert a repelling force upon each other. The magnets 10, 11 in this embodiment are positioned so as to urge the spout 8 outwards towards the extended position. For example, the first polarized magnet 10 attached or embedded within the cap 1 at a position further from the upper surface 4 of the cap 1 than the second polarized magnet 11 when the spout 8 is in the retracted position. With the two magnets 10, 11 close together in the retracted position and with the second polarized magnet 11 on the spout 8 located 'above' (i.e. closer to the upper surface 4) than the first polarized magnet 10, the magnetic biasing pushes the spout 8 away from the first polarized magnet 10, causing the spout 8 to move towards the extended position.

A plurality of polarized magnets may also be used to implement the magnetic biasing for embodiments employing magnets with opposite polarity poles facing or with same polarity poles facing, as described above. It will also be appreciated that in some implementations, one or more of the magnets may be annular or semi-annular, or any other suitable shape.

The magnets 10, 11 may be attached or embedded within the cap 1 or spout 8, as the case may be. Methods for attachment may include adhesives, snap-fit into recesses, or other mechanisms or combinations of mechanisms. In some instances, the magnets may be enclosed within the walls of the cap 1 or spout 8. In some cases, they may be placed within the walls during an injection molding process for forming the parts of the spout assembly 100. Other methods of attaching or embedding the magnets for particular applications will be appreciated by those ordinarily skilled in the art in light of the present description.

The interior of the cap 1 may include various guides, slots, flanges, or other projections to restrict the spout 8 from rotating within the axial passageway 7, thereby restricting the freedom of movement to translational movement between the retracted position and extended position. Cooperating guides, slots, projections, etc., may be present on the spout 8 in some embodiments. For example, in the example shown in FIGS. 1 and 2, the spout 8 is approximately half cylindrical, and thus has longitudinal edges 30. The longitudinal edges 30 are parallel to the axis of the axial passageway 7. The cap 1 may include inner tabs or projections 32 adjacent the longitudinal edges 30 to maintain the spout 8 in its rotational position and restrict it to moving between the retracted and extended positions.

It will be appreciated that the movement of the spout may also be rotational and not only be restricted to translational movement between the retracted position and the extended position. In such example embodiments, the interior of the cap 1 may include any suitable guides, slots, flanges or other projections to guide the directional movement of the spout 8 to the extent desirable for a given implementation.

The spout 8 may include tabs, flanges or other projections to connect the spout 8 to the cap 1, and prevent the spout 8 from being detached from the cap 1 when the spout 8 is in the retracted position. Cooperating slots, projections, flanges, etc. may be present on the cap 1. In the example embodiment shown in FIG. 2, the spout 8 includes an outer tab 34 adjacent to the top edge 36 of the spout 8 that fits into a slot 38 on the upper surface 4 of the cap 1 when the spout 8 is in the retracted position, thereby preventing the spout 8 from descending lower into the axial passageway 7. The tab 34 lifts from the slot 38 vertically as the spout 8 moves from the retracted position to the extended position.

Reference is again made to FIG. 2, which shows a perspective view of the spout assembly when the spout 8 is in the extended position. The lid 5 is in the open position allowing the spout 8 to extend beyond the upper surface 4 of the cap 1 to facilitate the pouring of the contents of bottle. The inwardly projected flange 3 of the cap 1 engages the outwardly projected flange 9 of the spout 8.

Reference is also again made to FIG. 3, which shows an example embodiment of the oppositely polarized magnets 10, 11. The first polarized magnet 10 located at the inwardly projected flange 3 of the cap 1 magnetically attracts the second polarized magnet 11 located at the outwardly projected flange 9 of the spout 8.

In any of the forgoing embodiments, a seal 12 may be provided along at least a portion of the inwardly projecting flange 3 of the cap 1 to prevent leakage of fluids between the flanges 3, 9 when the spout 8 is in the extended position. The seal 12 may be made of rubber, plastic, or other suitable compression sealing materials.

Figure 4:
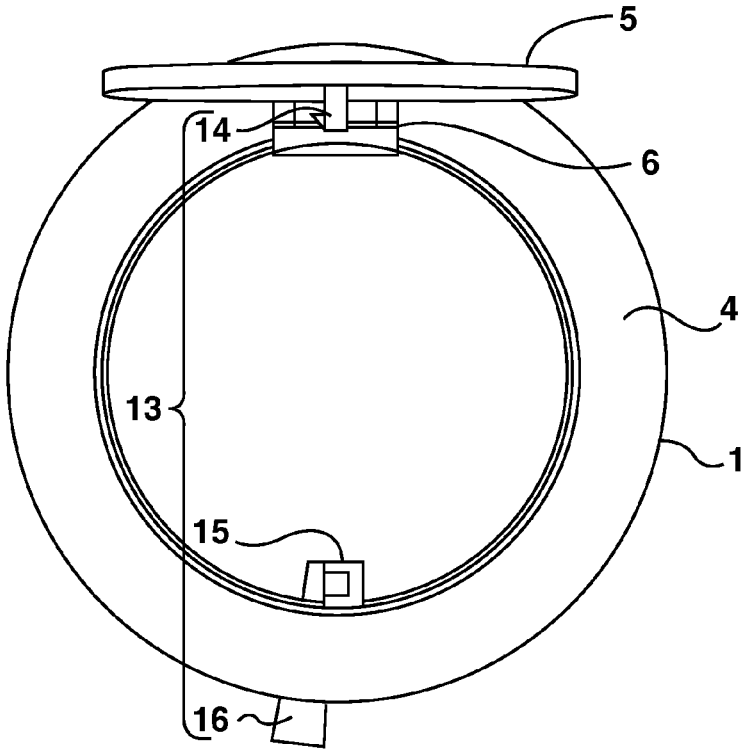
FIG. 4 shows a top view of a cap excluding the spout.

Reference is now made to FIG. 4, which shows a top view of the cap 1 excluding the spout 8. The cap 1 in this embodiment may include a locking mechanism 13 to seal the lid 5 with the upper surface 4 of the cap 1. The locking mechanism 13 in this example includes a hook 14, a loop 15 and a release trigger 16. The hook 14 is located on the underside of the lid 5. The loop 15 is mounted to the cap 1 and extends into the axial passageway 7. The release trigger 16 is operatively connected to the loop 15 and extends beyond the outside of the cap 1. The hook 14 inserts in the loop 15 locking the lid 5 to the upper surface 4 of the cap 1 when the lid 5 is in the closed position. The release trigger 16, when actuated, causes a portion of the loop 15 to move sideways, thereby disengaging the hook 14 and thereby releasing the lid 5 from the closed position. It will be understood that this is but one example locking mechanism 13 and that other mechanisms may be used to hold the lid 5 against the upper surface of the cap 1 including, but not limited to the use of a pop-out button or a push-out button mechanism to trigger release the lid from the closed position to the open position when force is applied to the button. It will also be appreciated that in other example embodiments, the lid may form a seal with other portions of the cap 1 including the inwardly projected flange 3 of the cap 1 whereby the lid may or may not be disposed within the axial passageway 7 when the lid 5 is in the closed position.

The lid 5 may, in some embodiments, be spring biased to pivot to the open position, such that when the locking mechanism 13 is released, the lid 5 tends to open. In some example implementations, the spring biasing may be incorporated into the hinge mechanism 6. In another embodiment, as will be described below, the lid 5 may be alternative or additionally magnetically biased towards an open position.

In some embodiments, the lid 5 may incorporate a vacuum seal feature, such as a pump mechanism for pumping air out of the container when the lid 5 is in a closed position.

Figure 5:
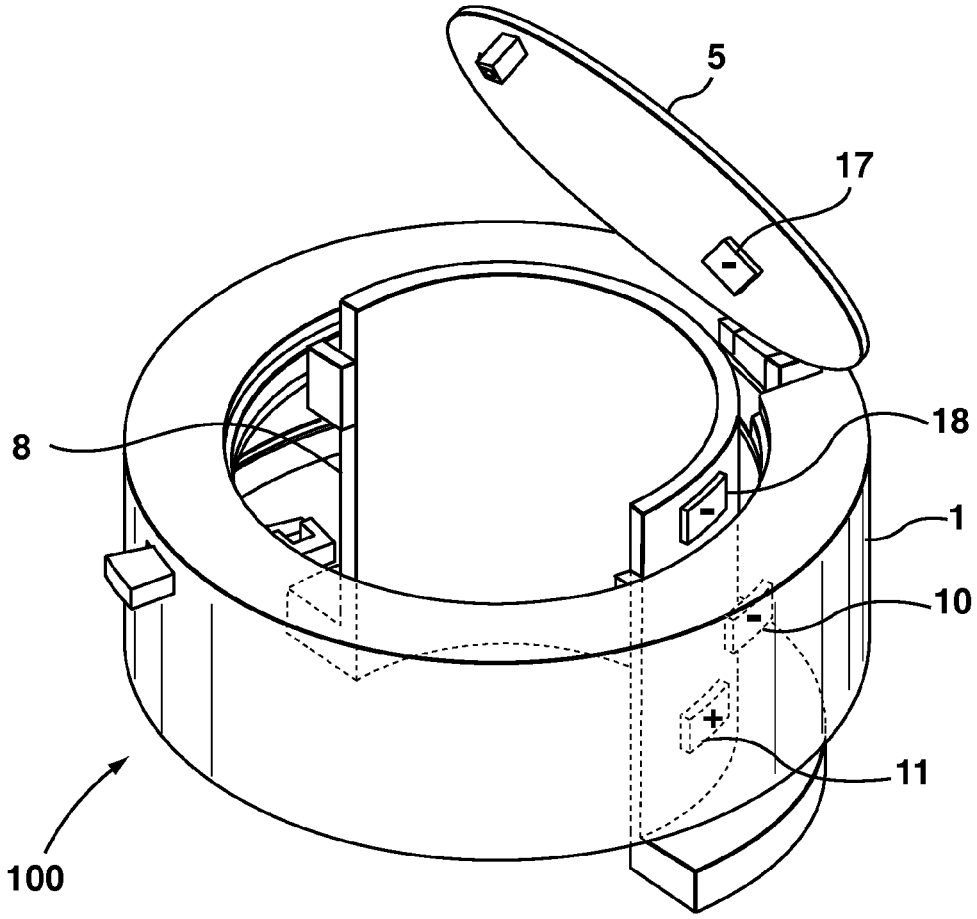
FIG. 5 shows a perspective view of another embodiment of the spout assembly.

Reference is now made to FIG. 5, which shows a perspective view of another embodiment of the spout assembly 100. In this embodiment, a third polarized magnet 17 is attached to the lid 5. A fourth polarized magnet 18 may be attached to the upper end of the spout 8. The third polarized magnet 17 and the fourth polarized magnet 18 are positioned to have the same polarity poles facing each other, thereby forming a reactive magnetic force that tends to repel the magnets 17, 18 apart. When the lid 5 is unlocked, the magnetic biasing of the magnets 17, 18 tends to cause the lid 5 to pivot upwards and away from the spout 8 as the spout 8 extends from the retracted position to the extended position.

In the embodiment illustrated in FIG. 5, the first and second polarized magnets 10, 11, have opposite polarity poles facing each other, and thus rely on an attractive magnetic force to draw the spout 8 up into the extended position. Accordingly, it may be advantageous for the fourth polarized magnet 18 be positioned such that its pole facing the first polarized magnet 10 shares the same polarity as that pole of the first polarized magnet 10, so as to tend to reinforce the magnetic reactive force that urges the spout 8 towards the extended position, rather than counteracting it. The fourth polarized magnet 18 may be selected to be a relatively weak magnet in comparison to the first polarized magnet 10 and the second polarized magnet 11, and is located sufficiently far from the first polarized magnet 10 that any attractive forces between the first polarized magnet 10 and the second polarized magnet 11 do not significantly counteract the bias towards the extended position and the opening of the lid 5.

Figure 6:
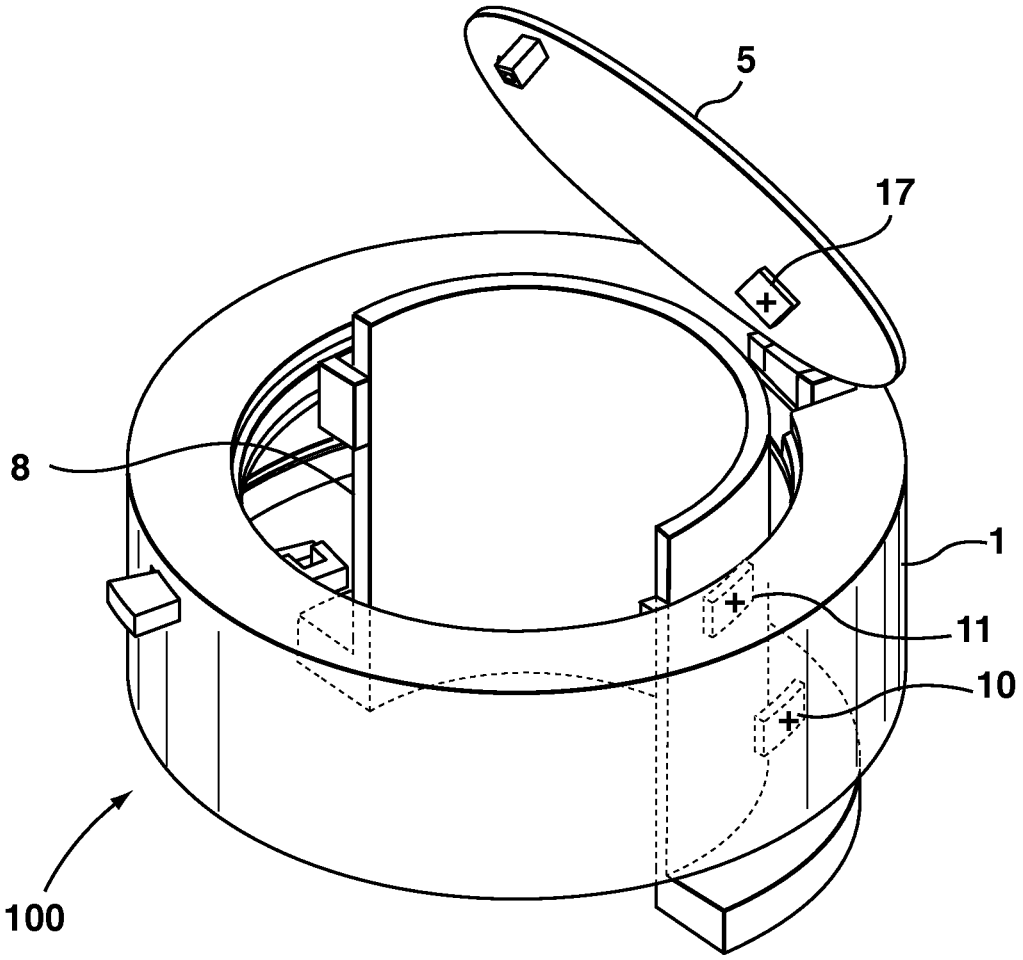
FIG. 6 shows a perspective view of a further embodiment of the spout assembly.

In yet a further embodiment shown in FIG. 6, the spout 8 may not have the fourth polarized magnet 18. In this embodiment the functions of both the second and fourth polarized magnets 11, 18 are realized using a single magnet—the second polarized magnet 11. In such an embodiment, the first polarized magnet 10 is located at a lower level position than the second polarized magnet 11 and the two magnets 10, 11 have the same polarity poles facing each other to cause a repelling force. The other pole of the second polarized magnet 11 faces the third polarized magnet 17, which is positioned to have the same polarity pole facing the second polarized magnet, thereby also providing a repelling force. When the lid 5 is unlocked, the magnetic biasing pushes the spout 8 away from the cap 1, and pivots the lid 5 upwards and away from the spout 8 as the spout 8 extends from the retracted position to the extended position.

As noted above, any one or more of the first, second, third and fourth polarized magnets 10, 11, 17, 18 may be implemented using a plurality of magnets.

Figure 7A:
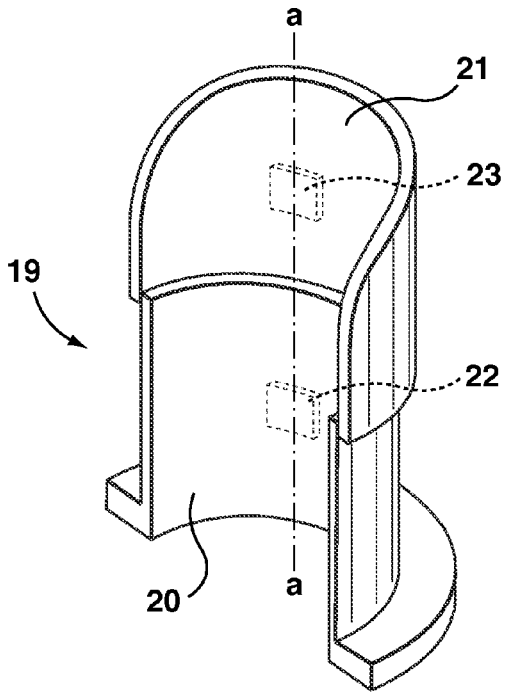
FIGS. 7*a* and 7*b* show an example of a two-piece spout.
Figure 7B:
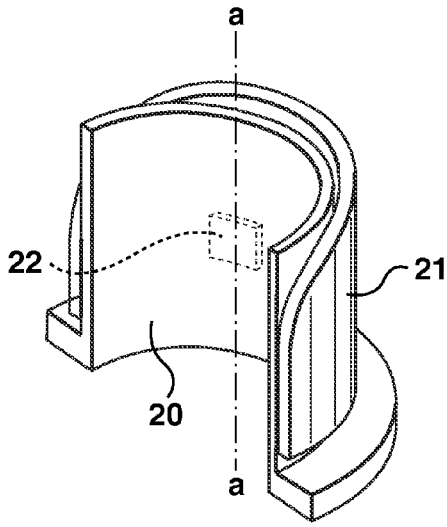

Reference is now made to FIGS. 7*a* and 7*b*, which show an example of a two-piece spout 19 for an alternative embodiment of the spout assembly. In this embodiment, the two-piece spout 19 is configured to telescope during extension. The two-piece spout 19 is shown in a telescoped position in FIG. 7*a* and in a nested position in FIG. 7*b*. The two-piece spout 19 includes an inner piece 20 and an outer piece 21. The inner piece 20 is nested within the outer piece 21 when the two-piece spout 19 is in the retracted position. The inner piece 20 and outer piece 21 telescope apart from each other when the two-piece spout 19 is in the extended position. The two pieces 20, 21 may be movably connected to each other using any mechanism for permitting translational and/or rotational movement, including, for example, cooperating grooves/slots and projections, or other mechanisms.

In some example embodiments of the two-piece spout 19 (not shown), the inner piece 20 may include an opening to allow the outer piece 21 to be disposed within the opening and housed within the inner piece 20 when the two-piece spout 19 is in the retracted position. The outer piece 21 telescopes out of the opening of the inner piece 20 when the two-piece spout 19 is in the extended position.

It will be appreciated that the present application is not limited to two-piece spouts 19 and may include a plurality of piece spouts. For example, embodiments may include three-piece spouts or four-piece spouts. In such embodiments, the inner pieces may be nested within an outer piece when the spout is in the retracted position. Each of the pieces may be configured to telescope apart from each of the adjacent pieces when the spout is in the extended position.

Figure 7C:
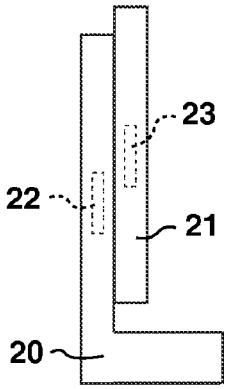
FIGS. 7*c* and 7*d* show a cross-sectional view of the two-piece spout.
Figure 7D:
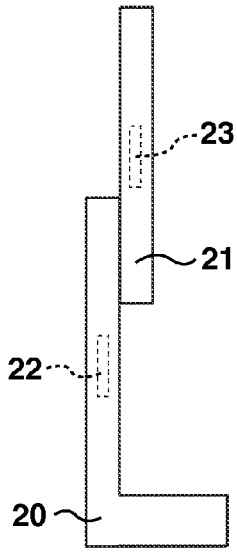

The two-piece spout 19 may be magnetically biased towards the telescoped position shown in FIG. 7*a*. The inner piece 20 may include a fifth polarized magnet 22, and the outer piece 21 may include a sixth polarized magnet 23. Reference is now also made to FIGS. 7*c* and 7*d*, which show a cross-sectional view of the two-piece spout 19 along the line a-a. FIG. 7*c* illustrates the two-piece spout 19 in the nested position, while FIG. 7*d* illustrates the two-piece spout 19 in the telescoped position.

The fifth polarized magnet 22 and sixth polarized magnet 23 in this embodiment are positioned to have poles of the same polarity facing each other, such that they exert a repelling force upon each other, thus urging the two-piece spout 19 into the telescoped position. The fifth polarized magnet 22 in the inner piece 20 is located "lower" or "below" the sixth polarized magnet 23 when in the nested position, so as to cause the outer piece 21 to extend upwards away from the fifth polarized magnet 22.

Figure 8:
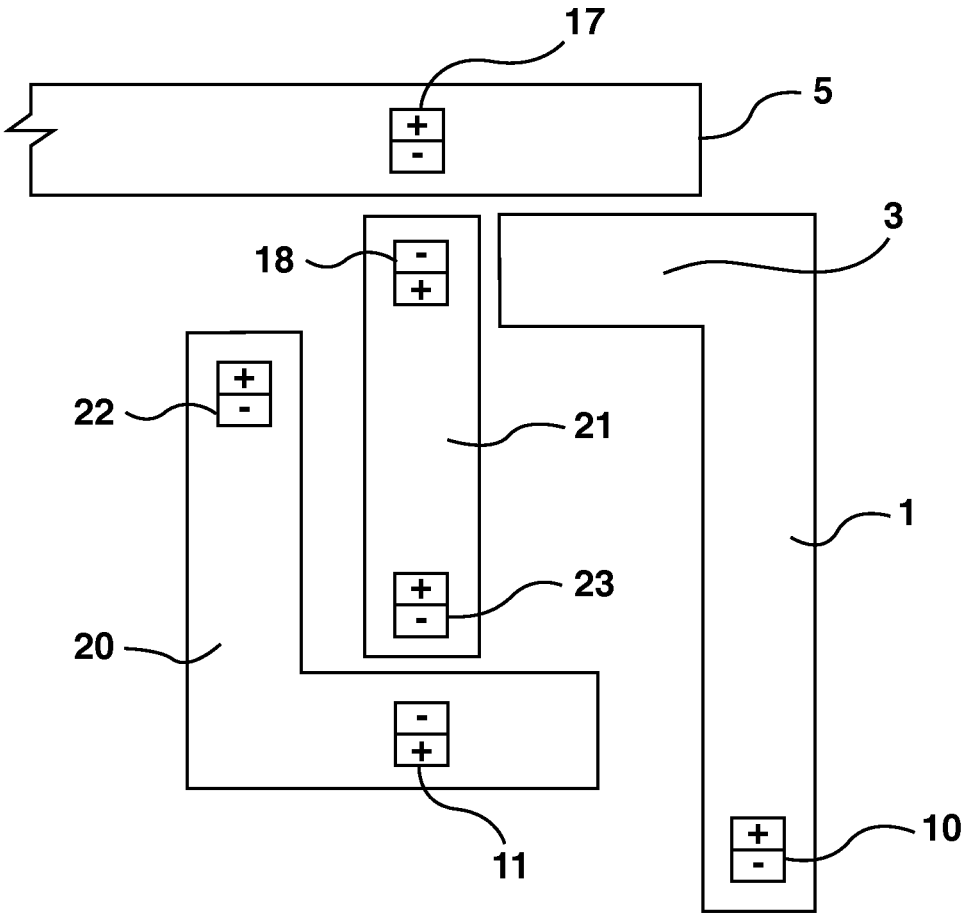
FIG. 8 shows a simplified cross-sectional diagram of an embodiment of the spout assembly.

Reference is now made to FIG. 8, which shows a simplified cross-sectional diagram of an embodiment of the spout assembly 100 including the two-piece spout 19. In this example embodiment, the sixth polarized magnet 23 and fifth polarized magnet 22 have opposite polarity poles facing each other and are drawn together to bias the two-piece spout 19 towards the telescoped position. It will be noted that in this embodiment the sixth polarized magnet 23 is located proximate the second polarized magnet 11 when in the nested position. The second polarized magnet 11 may thus be arranged to have a same polarity pole facing the sixth polarized magnet 23, thereby reinforcing the bias towards the telescoped position. The first polarized magnet 10 is positioned to repel the spout 19 through interaction with the second polarized magnet 11. It will be appreciated that the strength and positioning of the magnets in this embodiment is to be selected to ensure that the attractive force between the sixth polarized magnet 23 and the first polarized magnet 10 is not so strong as to prevent the magnetic biasing otherwise established.

The fifth polarized magnet 22 is located at the upper end of the inner piece 20 and when the two-piece spout 19 is in the retracted position the fifth polarized magnet 22 is proximate the fourth polarized magnet 18. The fourth polarized magnet 18 is positioned so as to have its polarity reinforce the telescoping bias through a repelling force vis-à-vis the fifth polarized magnet 22.

Figure 9:
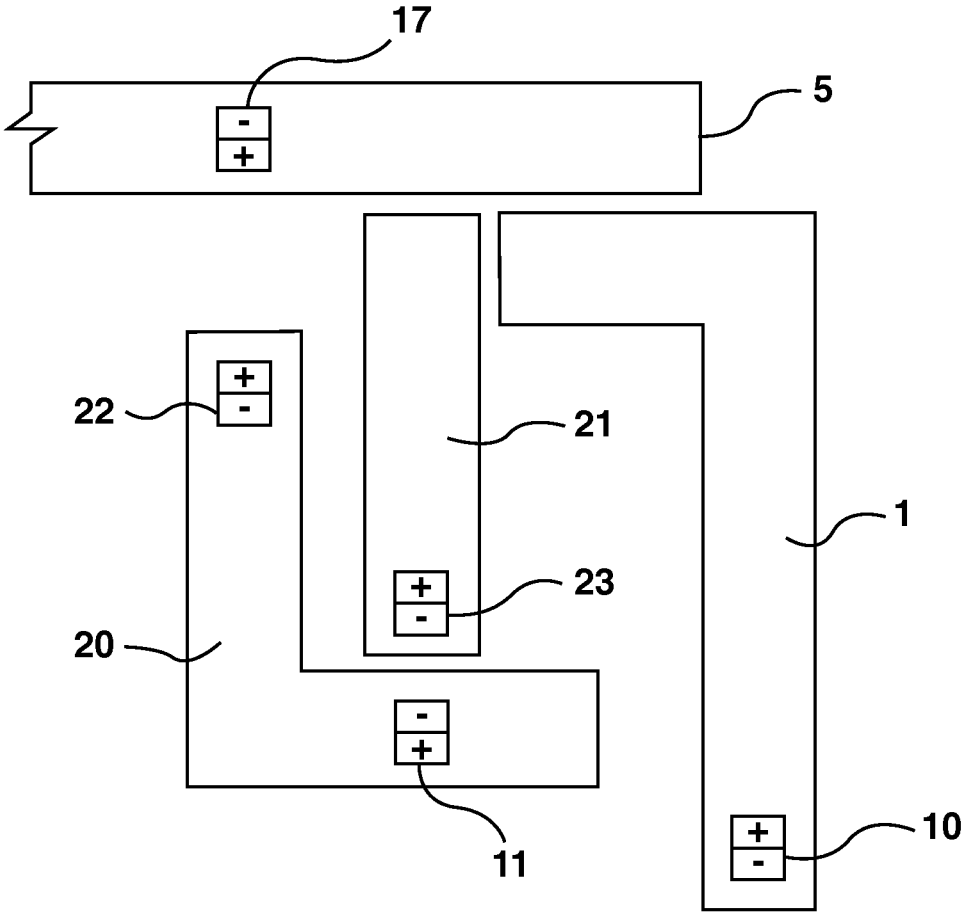
FIG. 9 shows a simplified cross-sectional diagram of another embodiment of the spout assembly.

FIG. 9 shows a simplified cross-sectional view of another embodiment. In this example embodiment, the fourth polarized magnet is not present. The fifth polarized magnet 22 and the third polarized magnet 17 have opposite polarity poles facing each other and are of sufficient proximity to form a repelling magnetic force whereby the fifth polarized magnet 22 causes the lid 5 to bias upward and away from the spout through interaction with the third polarized magnet 17 when the lid 5 is in the open position. It will be understood that the fifth polarized magnet 22 and the third polarized magnet 17 are of sufficient magnetic strength in order to form a repelling magnetic force with one another.

Figure 10:
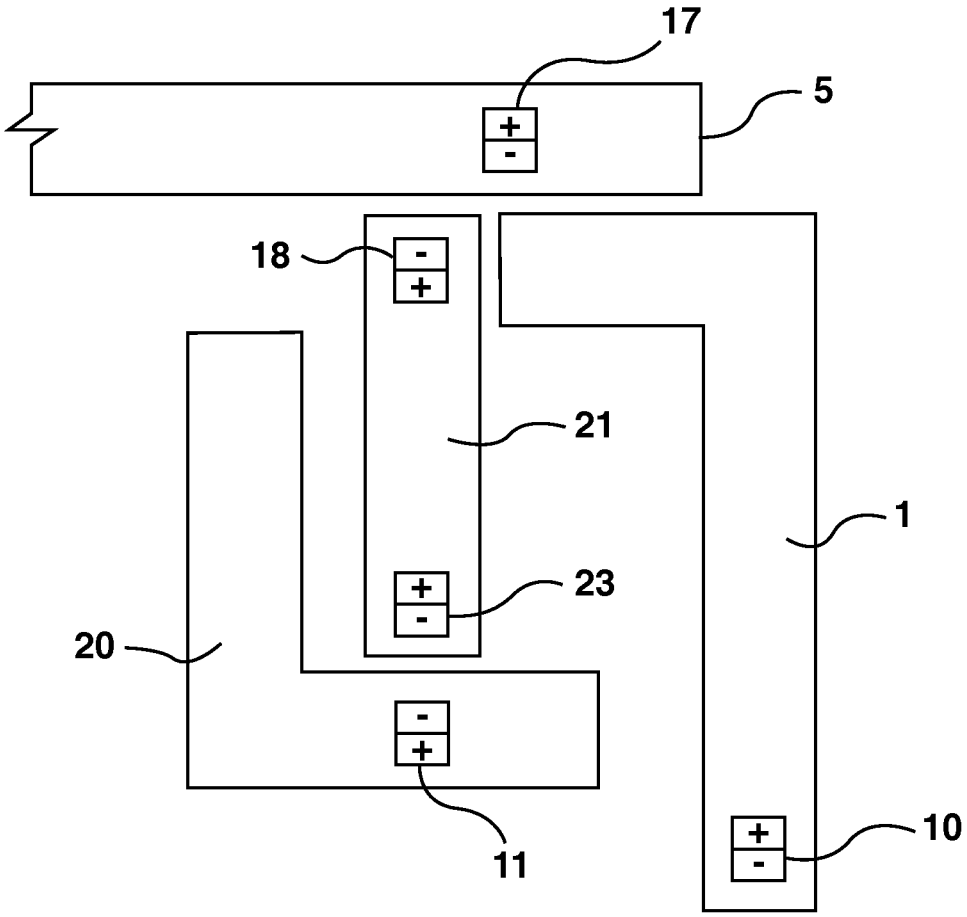
FIG. 10 shows a simplified cross-sectional diagram of a further embodiment of the spout assembly.

FIG. 10 shows a simplified cross-sectional view of a further embodiment. In this embodiment in FIG. 10, the fifth polarized magnet is not present. All magnetic forces in this embodiment are repulsive forces.

Figure 11:
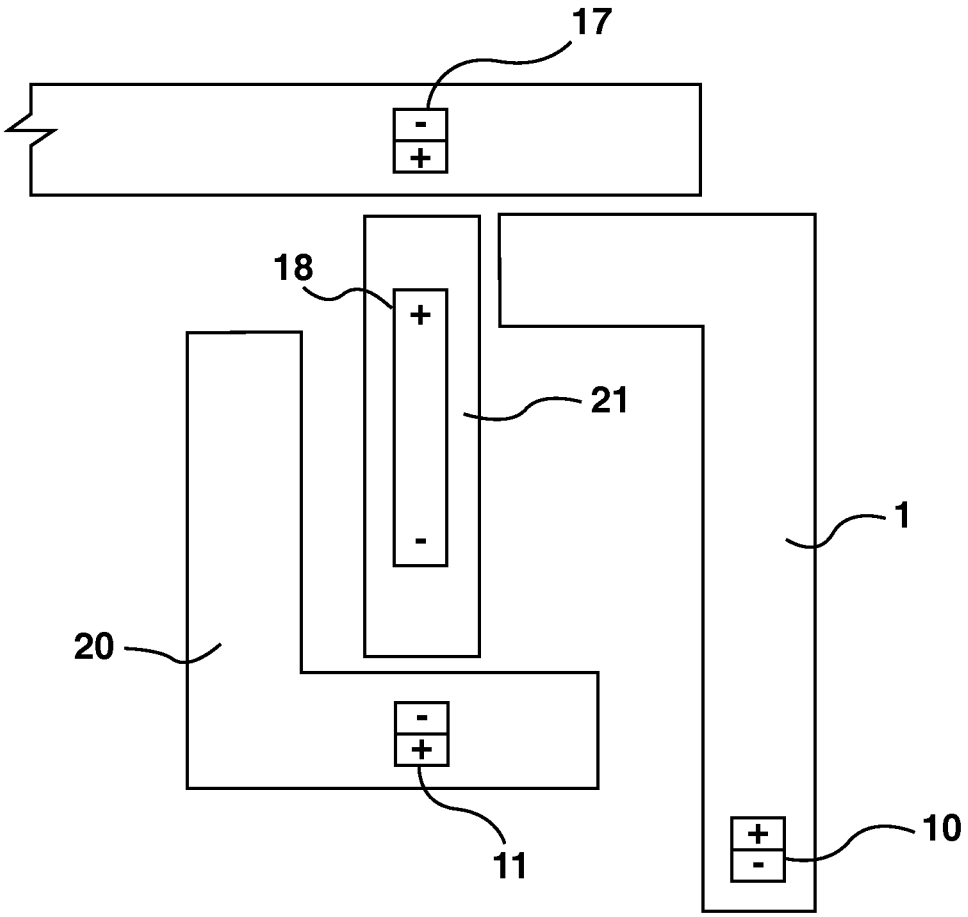
FIG. 11 shows a simplified cross-sectional diagram of a yet further embodiment of the spout assembly.

In yet a further embodiment illustrated in FIG. 11, the fourth and sixth polarized magnets are realized through a single magnet, e.g. the fourth polarized magnet 18. Again, in this embodiment all magnetic forces are repulsive forces.

Figure 12:
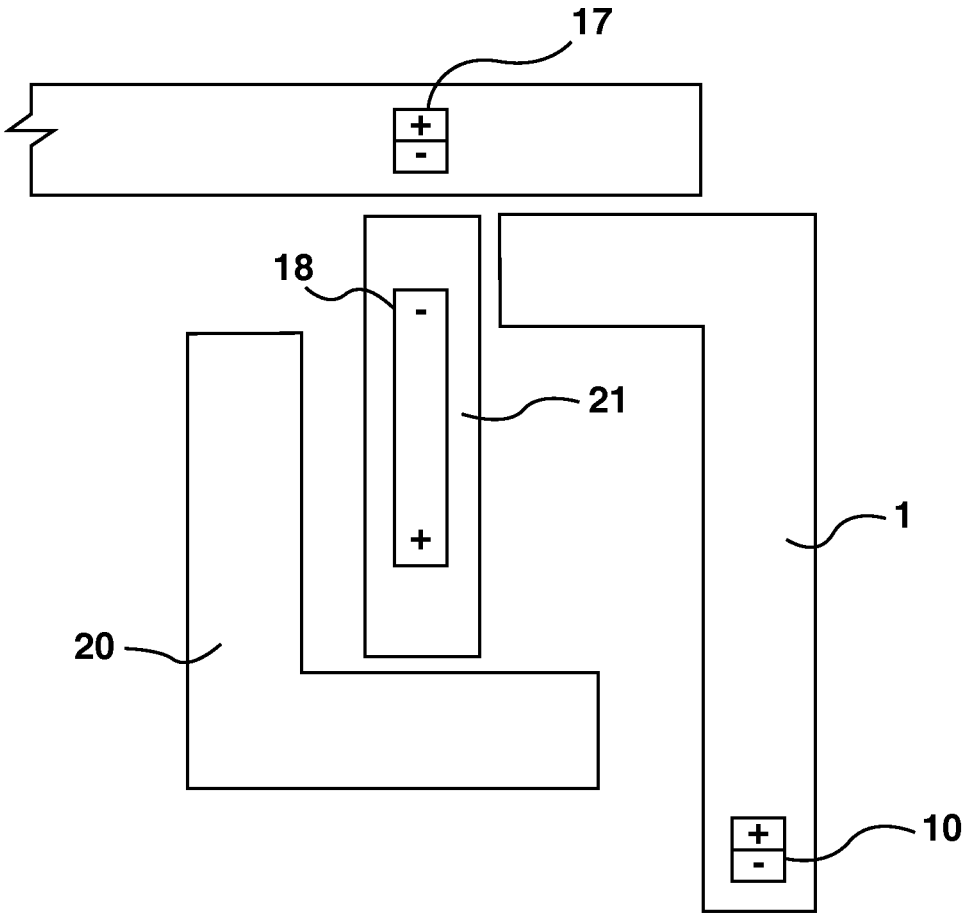
FIG. 12 shows a simplified cross-sectional diagram of another embodiment of the spout assembly.

It may not be necessary to include any magnets in the inner piece 20 as illustrated in the example embodiment in FIG. 12. In such an example embodiment, the second polarized magnet is removed. Repulsive magnetic forces are formed between the first polarized magnet 10, the fourth polarized magnet 18 and the third polarized magnet 17. In some example embodiments, the outer piece 21 may be appropriately connected to the inner piece 20, for example, by cooperating grooves/slots and projections in order for the outer piece 20 to carry the inner piece 20 above the upper surface 4 of the cap 1 prior to the outer piece 21 telescoping apart from the inner piece 20 due to the repulsive magnetic forces.

As noted previously, a plurality of magnets may be used to implement the magnetic biasing as described above.

The spout assembly may be formed/molded from any suitable material. In one embodiment, the cap is formed/molded integrally with the container/bottle to which it is permanently attached. The range of materials and/or molding processes that may be suitable for implementing the spout assembly described above will be understood by those skilled in the art having regard to the present description.

Although many of the examples described above made specific reference to attachment to bottles, it will be appreciated by those skilled in the art that the spout assembly is not limited in application to bottles. The spout assembly may be configured to be attached to the mouth of other containers. For example, in some example embodiments, the spout assembly may be configured to be attached to the mouth of a jar or a canister, such as a gasoline canister.

Certain adaptations and modifications of the described embodiments can be made. Therefore, the above discussed embodiments are considered to be illustrative and not restrictive.

What is claimed is:

1. A spout assembly configured to be attached to a mouth of a container, the spout assembly comprising:

a cap having an upper surface and defining an axial passageway;

a spout mounted within the cap and movable between a retracted position, in which the spout is disposed within the axial passageway below the upper surface, and an extended position, in which at least a portion of the spout extends above the upper surface; and a first polarized magnet attached to the cap and a second polarized magnet attached to the spout, wherein the first polarized magnet and second polarized magnet magnetically bias the spout into the extended position.

2. The spout assembly of claim 1, wherein the first polarized magnet and the second polarized magnet have poles of the same polarity facing each other, and the first polarized magnet is located further from the upper surface than the second polarized magnet when the spout is in the retracted position.

3. The spout assembly of claim 1, wherein the first polarized magnet and the second polarized magnet have poles of opposite polarity facing each other, and the first polarized magnet is located closer to the upper surface than the second polarized magnet when the spout is in the retracted position.

4. The spout assembly of claim 1, wherein, the cap further comprises an inwardly projected flange within the axial passageway and adjacent the spout;

the spout further comprises an outwardly projected flange; and wherein the outwardly projected flange bears against the inwardly projected flange when the spout is in the extended position to prevent the spout from moving beyond the extended position.

5. The spout assembly of claim 1, further comprising a hinged lid attached to the cap, the hinged lid including a third polarized magnet.

6. The spout assembly of claim 5, wherein, when the spout is in the retracted position, the second polarized magnet is located between the first polarized magnet and the third polarized magnet; and the second polarized magnet and the third polarized magnet have same polarity poles facing each other and the second polarized magnet and third polarized magnet have same polarity poles facing each other, whereby the second polarized magnet and the third polarized magnet repel each other to pivot the lid away from the spout.

7. The spout assembly of claim 5, further comprising:

a fourth polarized magnet attached to the spout, wherein the fourth polarized magnet is located between the first polarized magnet and the third polarized magnet when the spout is in the retracted position, and the first polarized magnet is located between the second polarized magnet and the third polarized magnet; and wherein the third polarized magnet and the fourth polarized magnet have same polarity poles facing each other, whereby the fourth polarized magnet and the third polarized magnet repel each other to pivot the lid away from the spout.

8. The spout assembly of claim 5, wherein the hinged lid further includes a locking mechanism for maintaining the hinged lid in a closed position against a portion of the cap.

9. The spout assembly of claim 1, wherein the spout further comprises:

a two-piece spout having an inner piece and an outer piece whereby the inner piece is nested within the outer piece when the spout is in the retracted position, and wherein the inner piece is mounted for movement between a nested position and a telescoped position.

10. The spout assembly of claim 9, wherein the inner piece defines an opening and the outer piece is disposed within the opening when the spout is in the retracted position.

11. The spout assembly of claim 9, wherein the two-piece spout is magnetically biased towards the telescoped position.

12. The spout assembly of claim 11, wherein the two-piece spout includes the second polarized magnet attached to the inner piece, and a fourth polarized magnet attached to the outer piece, and wherein the second polarized magnet and fourth polarized magnet are positioned have same polarity poles facing each other to provide a repelling force biasing the two-piece spout into the telescoped position.

13. The spout assembly of claim 11, wherein the two-piece spout includes the second polarized magnet attached to the inner piece, and a fourth polarized magnet attached to an upper end of the outer piece, and a sixth polarized magnet attached to a lower end of the outer piece, and wherein the second polarized magnet and sixth polarized magnet are positioned have same polarity poles facing each other to provide a repelling force biasing the two-piece spout into the telescoped position.

14. The spout assembly of claim 13, wherein the two-piece spout further includes a fifth polarized magnet attached to an upper end of the inner piece at a location between the fourth polarized magnet and the sixth polarized magnet, and wherein the fifth polarized magnet and sixth polarized magnet have opposite polarity poles facing each other to provide an attractive force biasing the spout into the telescoped position.

15. A container comprising:

a bottle with a mouth; and a spout assembly as claimed in claim 1, wherein the spout assembly is attached to the mouth of the bottle.

* * * * *